US009605916B2

(12) United States Patent
Stickling et al.

(10) Patent No.: US 9,605,916 B2
(45) Date of Patent: Mar. 28, 2017

(54) CLEANING APPARATUS FOR COOLING TUBE ARRAY

(71) Applicant: Johannes Stickling, Philadelphia, PA (US)

(72) Inventors: Johannes Stickling, Philadelphia, PA (US); Thomas Stickling, Paderborn (DE)

(73) Assignee: Johannes Stickling, Philadelphia, PA (US)

( * ) Notice: Subject to any disclaimer, the term of this patent is extended or adjusted under 35 U.S.C. 154(b) by 178 days.

(21) Appl. No.: 14/491,173

(22) Filed: Sep. 19, 2014

(65) Prior Publication Data

US 2016/0084595 A1 Mar. 24, 2016

(51) Int. Cl.

| | |
|---|---|
| ***F28G 15/02*** | (2006.01) |
| ***F28G 9/00*** | (2006.01) |
| ***B08B 9/032*** | (2006.01) |
| *F28G 1/16* | (2006.01) |

(52) U.S. Cl.

CPC ..... *F28G 15/02* (2013.01); *B08B 9/0323* (2013.01); *F28G 9/00* (2013.01); *F28G 1/166* (2013.01)

(58) Field of Classification Search

None

See application file for complete search history.

(56) References Cited

FOREIGN PATENT DOCUMENTS

| | | | | |
|---|---|---|---|---|
| DE | 2317273 | A2 * | 5/2011 | |
| DE | 102009052676 | A1 | 5/2011 | |
| DE | 102010010011 | A1 | 5/2011 | |
| DE | 202010017403 | U1 | 1/2012 | |
| DE | 10 2012021178 | A1 * | 12/2013 | ..... F28G 15/02 |
| DE | 102012021177 | A1 | 12/2013 | |
| DE | 102012021178 | A1 | 12/2013 | |
| EP | 1604164 | B1 | 10/2006 | |
| EP | 2317273 | A2 | 10/2010 | |
| EP | 2317274 | A2 | 10/2010 | |
| WO | 2013178353 | A2 | 12/2013 | |

* cited by examiner

*Primary Examiner* — Michael Barr
*Assistant Examiner* — Cristi Tate-Sims
(74) *Attorney, Agent, or Firm* — Richard M. Goldberg

(57) ABSTRACT

A cleaning apparatus for cleaning a cooling tube array of a heat exchanger, including a triangular truss beam supported to be movable in a first direction, which direction is perpendicular to a longitudinal direction of the truss beam, a nozzle carriage movably held on the truss beam, the nozzle carriage being movable along the longitudinal direction of the truss beam, and a plurality of cleaning nozzles mounted to the nozzle carriage, the truss beam having two tubular top chords and one tubular bottom chord that is arranged centrally below the top chords, and bracings that connect the chords, and the nozzle carriage having at least one bottom chord roller that is arranged for traveling on the bottom side of the bottom chord; and a cleaning apparatus having a square truss beam.

15 Claims, 5 Drawing Sheets

CLEANING APPARATUS FOR COOLING TUBE ARRAY

FIELD OF THE INVENTION

The invention relates to a cleaning apparatus for a cooling tube array of a heat exchanger or condenser, in particular an air cooled condenser of, for example, a power station or a chemical plant.

BACKGROUND OF THE INVENTION

In a typical air cooled condenser of a fuel, coal or gas-fired power station, steam flows into cooling tube arrays or bundles, which are cooled by a forced air flow. Two arrays, which each form a generally flat, rectangular field, are erected to form an A-shaped structure. The cooling tubes are fin tubes, i.e. tubes having cooling fins integrally mounted or formed thereon. The steam enters the cooling tubes in parallel flow from the top. Fans that are arranged below the structure draw ambient air and discharge it along the cooling tubes for cooling. The air crosses the tube arrays from below.

Because of the outdoor installation, and because the fans draw ambient air, dirt gradually accumulates on the cooling tube arrays. Resulting cooling performance deficits may involve performance deficits of the power station, so that cleaning is required. However, cleaning large cooling tube arrays manually using high-pressure cleaners is dangerous and hard labor. For example, ambient temperatures at the working area may even reach e.g. 60° C. to 70° C. A cooling tube array may have a height along the inclined direction of the tubes of e.g. 10 meters, and may extend over a length of e.g. 80 meters in the lateral direction. The inclination angle may be 60° or more with respect to the horizontal.

WO 2013/178353 A2 describes a cleaning apparatus for spraying cooling coils with water. The apparatus has travelling profiles that can be displaced over the cooling coils, and a carrying system for nozzles can be displaced on the travelling profiles. The nozzle-carrying system is arranged above the travelling profiles and carries separate rows of nozzles on both sides of the carrying system, so that the travelling profiles may be supported from below while permitting the nozzle-carrying system to travel onto a portion of the travelling profiles that extends beyond the support, without interfering with the support. In one example, a triangular truss beam has three chord tubes, and the nozzle-carrying system is carried on the top chord tubes by respective pairs of rollers that are displaced in the circumferential direction of the respective chord tube on which they travel. The single lower chord tube is mounted on a column of a support of upside down T-shape that may be passed by the nozzle-carrying system. Thereby, a cleaning width of the rows of nozzles may be increased as compared to a cleaning width of a conventional cleaning apparatus, in which the nozzle-carrying system is arranged below a travelling profile and is dimensioned in order to be able to pass through a support portal that supports the travelling profile. Further examples also describe a square truss beam. In one example, pairs of rollers travel on two bottom chord tubes of the truss beam. In another example, pairs of rollers travel on two top chord tubes of the truss beam.

DE 10 2012 021 177 A1 and DE 10 2012 021 178 A1 describe similar cleaning devices.

EP 1604164 B1 and DE 10 2009 052 676 A1 describe a mobile cleaning device for air cooled condensation units, in which a cleaning nozzle carrier is displaceable suspended from a square profile that is arranged such that a diagonal of the square is vertical. The carrier comprises rollers that travel on the flat sides of the square profile.

EP 2 317 274 A2 and DE 20 2010 017 403 U1 describe cleaning devices for a heat exchanger, with a ladder consisting of side walls and ladder rungs, to which two parallel arranged profiles are fastened, in or on which a nozzle holder is movable. The ladder is mounted on a cooling roof of the heat exchanger. Water is supplied via a tube that is arranged to form a bend, which is laid flat onto a supporting surface of the ladder arrangement of the cleaning device, which surface is parallel to the plane of the cooling roof. Forming the bend allows the tube to follow the movement of the nozzle holder up and down along the ladder.

EP 2 317 273 A2 and DE 10 2010 010 011 A1 describe similar cleaning devices, wherein the water supply tube is arranged in an energy chain, which guides the tube and limits a bending angle of the tube and protects the tube.

SUMMARY OF THE INVENTION

It is an object of the present invention to provide a cleaning apparatus of the kind mentioned initially which has a high structural strength and allows for a high cleaning water output pressure.

A further object of the invention is to provide a cleaning apparatus of the kind mentioned initially which is easier to handle and which facilitates the manual work when cleaning a cooling tube array.

A further object of the invention is to provide a cleaning apparatus of the kind mentioned initially which is easy to assemble on site.

To better address one or more of these objects, in a first aspect of the invention there is provided a cleaning apparatus for cleaning a cooling tube array of a heat exchanger, comprising:

- a triangular truss beam supported to be movable in a first direction, which direction is perpendicular to a longitudinal direction of the truss beam,
- a nozzle carriage movably held on the truss beam, the nozzle carriage being movable along the longitudinal direction of the truss beam, and
- a plurality of cleaning nozzles mounted to the nozzle carriage,
- wherein the truss beam comprises two tubular top chords, one tubular bottom chord that is arranged centrally below the top chords, and bracings that connect the chords, and
- wherein the nozzle carriage comprises at least one bottom chord roller that is arranged for traveling on the bottom side of the bottom chord.

When water is ejected from the cleaning nozzles towards the cooling tube array in large amounts of e.g. 160 liters per minute and with a supply pressure of e.g. 80 bar, large forces result that act on the nozzle carriage in the opposite direction. The at least one bottom chord roller directly transfers the forces onto the triangular truss beam, and, in particular, the forces are applied to the bottom chord which is firmly stabilized against bending in upward directions by the structural strength of the triangular truss beam. Not only are forces distributed over the braced frames formed between the bottom chord and respective top chords, but because the forces are applied to the central bottom chord of the triangular cross section of the truss beam, the structure is also stabilized against laterally bending or twisting.

Preferably, the at least one bottom chord roller is arranged at the central, lowest circumferential position of the bottom chord. Preferably, a respective axis of the at least one bottom chord roller is arranged in said first direction, which, in general, is a horizontal direction. Thus, the at least one bottom roller is arranged centrally below the triangular truss beam and the bottom chord thereof. Therefore, the above mentioned forces acting on the nozzle carriage may be transferred via the at least one bottom chord roller basically along a direction that is perpendicular to the rotation axis of the bottom chord roller. In other words, the roller axis is perpendicular to the direction of resulting combined spray forces of the nozzles. Thus, high loads may be transferred by the at least one bottom chord roller.

Preferably, the at least one bottom chord roller has a circumferential groove on its circumferential surface which engages a circumferential section of the bottom chord. In other words, the bottom chord roller surrounds a circumferential section of the bottom chord. Thereby, the roller is stabilized in lateral directions, i.e. against lateral displacements.

Preferably, the cleaning nozzles are arranged to eject water in a direction that is perpendicular to said first direction and perpendicular to the longitudinal direction of the truss beam.

Preferably, said plurality of cleaning nozzles comprises at least one row of cleaning nozzles that are connected in parallel to a common supply tube that is arranged below the triangular truss beam and extends across the longitudinal direction of the truss beam.

Preferably, said plurality of cleaning nozzles comprises two rows of cleaning nozzles that extend across the longitudinal direction of the truss beam and are arranged, with respect to the longitudinal direction of the truss beam, in front of the rollers and behind the rollers, respectively, such that the rollers are positioned, in said longitudinal direction, between the two rows of cleaning nozzles.

Preferably, the nozzle carriage comprises top chord rollers that are arranged for traveling on the top chords, and wherein the nozzle carriage comprises left and right side parts that form a generally V-shaped or U-shaped bracket which encloses the generally triangular outline of the triangular truss beam, and which connect at least one bearing of the at least one bottom chord roller to bearings of the top chord rollers. Preferably, the nozzle carriage fully encloses the cross section of the truss beam. For example, the left and right side parts may be connected by at least one cross-connection above the truss beam, wherein the V-shaped or U-shaped bracket and the cross-connection fully enclose the cross section of the truss beam.

Preferably, at each chord of the truss beam, on which chord there are arranged two or more rollers for traveling on said chord, the respective rollers are arranged in a single line perpendicular to the axes of the rollers. In other words, the rollers are arranged at the same circumferential angle position of the respective chord. This permits for a smooth rolling motion along the chord and prevents the nozzle carriage from getting stuck on the truss beam. Preferably, on each of the top and bot tom chords of the truss beam, there are arranged at least two rollers.

In a second aspect of the invention there is provided a cleaning apparatus for cleaning a cooling tube array of a heat exchanger, comprising:

- a square truss beam supported to be movable in a first direction, which direction is perpendicular to a longitudinal direction of the truss beam,
- a nozzle carriage movably held on the truss beam, the nozzle carriage being movable along the longitudinal direction of the truss beam, and
- a plurality of cleaning nozzles mounted to the nozzle carriage,
- wherein the truss beam comprises four tubular chords and bracings that connect the chords, and
- wherein the nozzle carriage comprises at least one bottom chord roller that is arranged for traveling on the bottom side of a bottom one of the chords, and at least one top chord roller that is arranged for traveling on the top side of an upper one of the chords. A square truss beam provides for structural strength, and the at least one bottom chord roller directly transfers the forces onto the truss beam, while the bottom and top chord rollers secure the nozzle carriage on the truss beam.

The features that have been described above and are described below with respect to the first aspect of the invention may be provided in a similar manner in the second aspect of the invention, which has the square truss beam instead of the triangular truss beam.

Further useful details of the invention are indicated in the dependent claims.

In a further development of the invention, the cleaning apparatus further comprises: a carrier chain, and a supply tube connected to the plurality of cleaning nozzles, wherein the supply tube is installed along the carrier chain, wherein, at one end of the carrier chain, the carrier chain is connected to the nozzle carriage, and wherein, distant from said one end, a part of the carrier chain is supported outside of the triangular truss beam in a position such that the nozzle carriage is enabled to pass said part when moving in a first traveling direction along the truss beam, by moving in which direction an increasing portion of the carrier chain is laid onto a chain support. For example, the chain support may be a longitudinal tray, and may, in particular, have side walls. For example, the chain support may be a trough-shaped tray having a U-shaped cross-section. However, the chain support may also be the truss beam or a part thereof. For example, the carrier chain is a limited-articulation carrier chain that permits bending from a straight configuration to one side only. Preferably, the carrier chain is oriented such that the bend is oriented vertically, i.e. upright. Thus, a narrow configuration of the truss beam is possible.

These features are also useful in connection with a cleaning apparatus in which the nozzle carriage is supported on a traverse beam in a manner different from the feature of the at least one bottom chord roller being arranged for traveling on the bottom side of a bottom chord of a triangular truss beam. For example, a cleaning apparatus for cleaning a cooling tube array of a heat exchanger may comprise:

- a traverse beam supported to be movable in a first direction, which direction is perpendicular to a longitudinal direction of the traverse beam,
- a nozzle carriage movably held on the traverse beam, the nozzle carriage being movable along the longitudinal direction of the traverse beam,
- a plurality of cleaning nozzles mounted to the nozzle carriage,
- a carrier chain, and
- a supply tube connected to the plurality of cleaning nozzles,
- wherein the supply tube is installed along the carrier chain,
- wherein, at one end of the carrier chain, the carrier chain is connected to the nozzle carriage, and
- wherein, distant from said one end, a part of the carrier chain is supported outside of the traverse beam in a position such that the nozzle carriage is enabled to pass said part when moving in a first traveling direction along the traverse beam, by moving in which direction an increasing portion of the carrier chain is laid onto a chain support.

In the following, a triangular truss beam is exemplarily described as one example of the traverse beam. For example, as described above, the truss beam may comprise two tubular top chords, one tubular bottom chord that is arranged centrally below the top chords, and bracings that connect the chords, wherein the nozzle carriage comprises at least one bottom chord roller that is arranged for traveling on the bottom side of the bottom chord.

For example, the chain support may be arranged on top of the traverse beam. When the supply hose is carried by the carrier chain, and the nozzle carriage is adapted to fully enclose the cross section of the truss beam together with the chain support and said portion of the carrier chain that has been laid onto the chain support, movement of the nozzle carriage over the full travelling span along the truss beam is simplified. The supply hose is securely guided on the chain support, and it is ensured that the supply hose does not interfere with the nozzle carriage. In particular, said movement may be enabled without requiring manual handling of the supply hose during said movement.

However, the chain support may also be arranged to one side of the traverse beam, i.e. laterally and e.g. separated from the traverse beam in order to let the nozzle carriage pass between the traverse beam and the chain support.

BRIEF DESCRIPTION OF THE DRAWINGS

The present invention will become more fully understood from the detailed description of a preferred embodiment given herein below and the accompanying drawings, and wherein.

DETAILED DESCRIPTION

Figure 1:
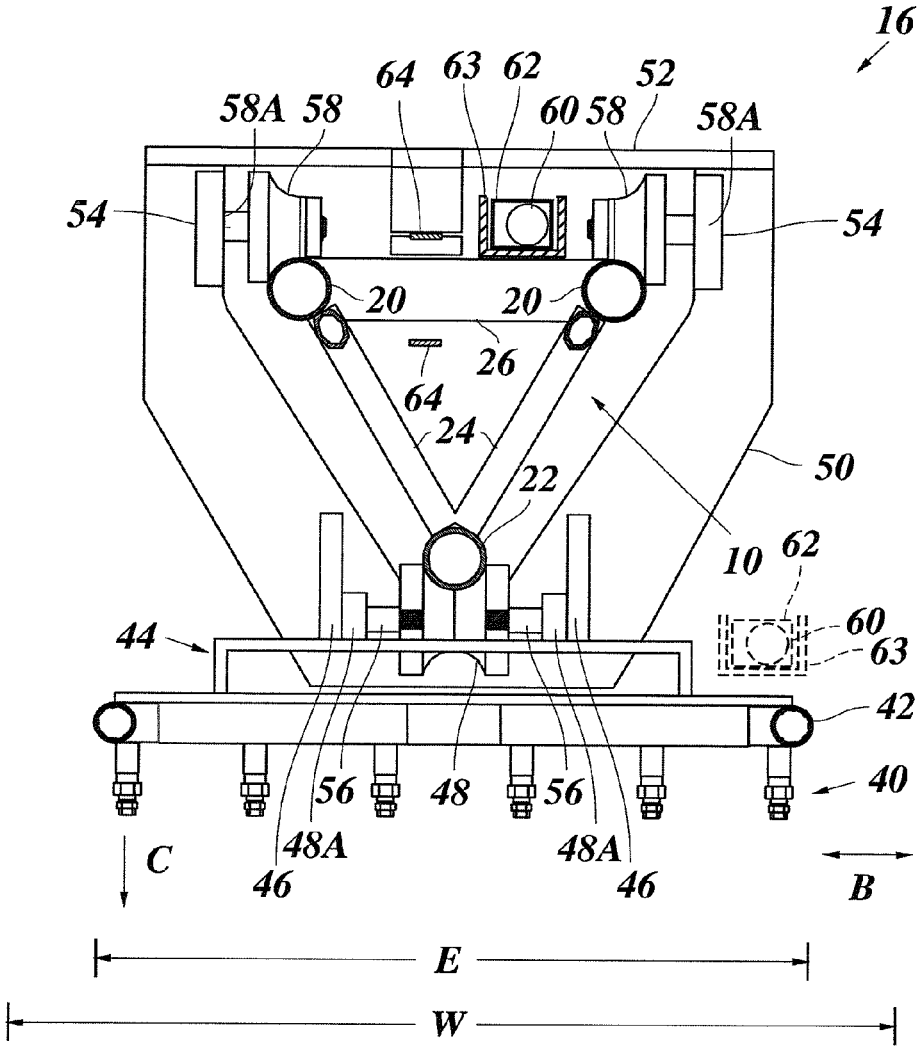
FIG. 1 is a schematic transverse sectional view of a triangular truss beam and a nozzle carriage of a cleaning apparatus.
Figure 2:
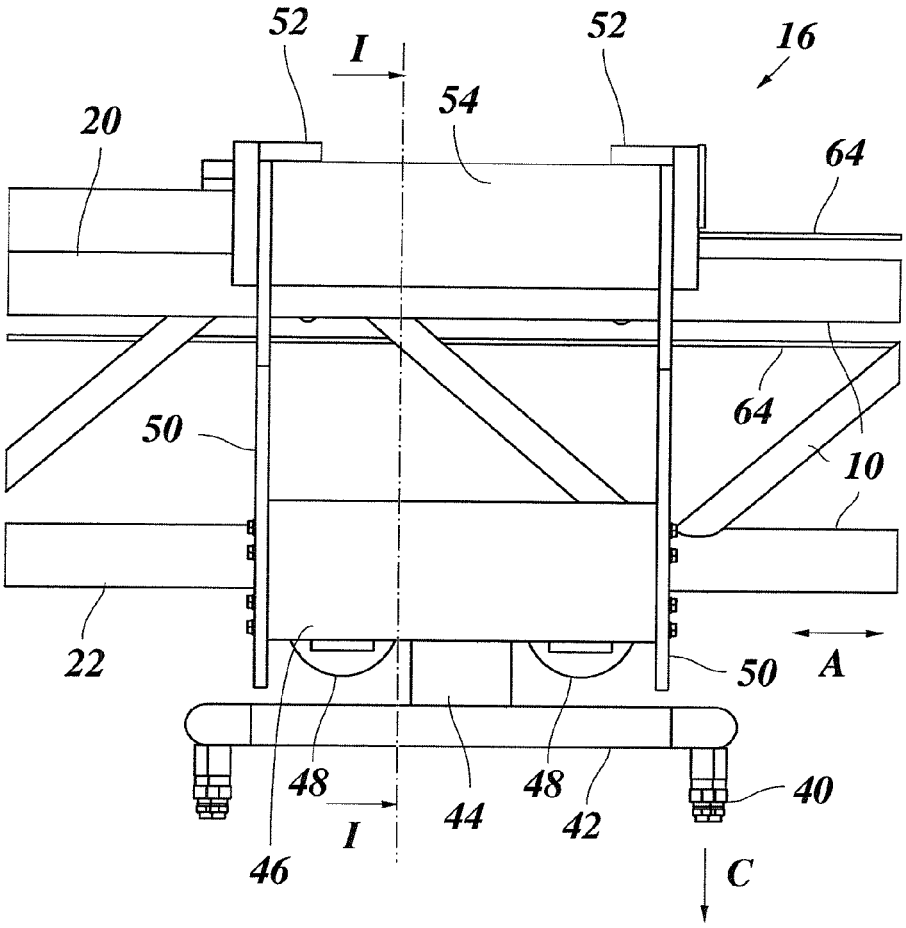
FIG. 2 is a partial side view of the truss beam and the nozzle carriage.
Figure 3:
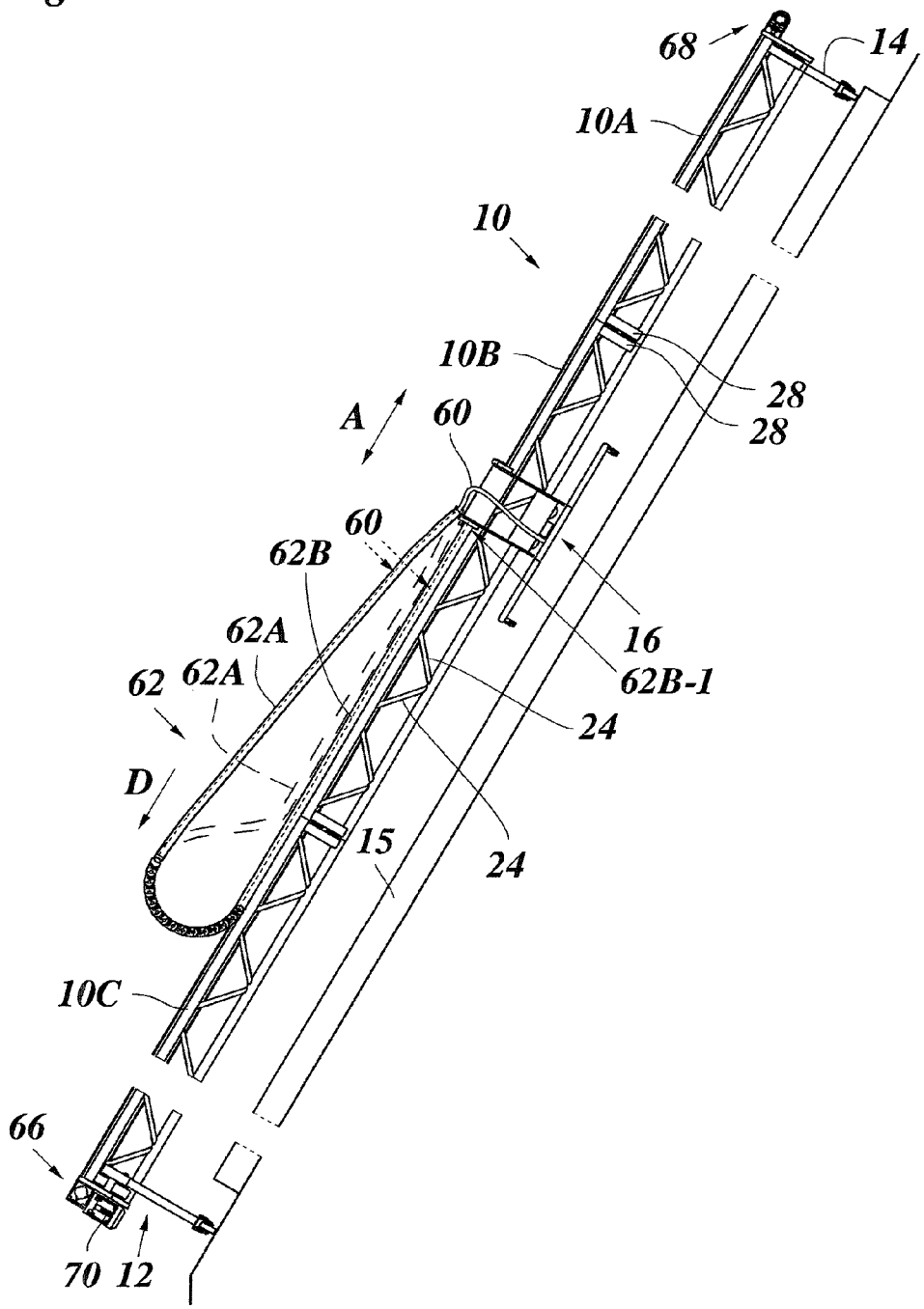
FIG. 3 is a side view of the cleaning apparatus.

The cleaning apparatus shown in FIGS. 1 to 3 is a cleaning apparatus for cleaning an outdoor cooling tube array of a heat exchanger.

A traverse beam in the form of a triangular truss beam 10 is adapted for bridging a span between a first support 12 on a first end of the truss beam 10 and a second support 14 on an opposite part of the truss beam 10. Preferably, said span has a length of at least 5 meters, and may e.g. be in the range of 5 to 20 meters, e.g. 10 meters, 12 meters or 14 meters. For example, the truss beam 10 may be arranged over a cooling tube array 15 that is inclined, the first support 12 being positioned at a low position next to a lower edge of the array 15, and the second support 14 being positioned at a high position on or above the inclined cooling tube array 15, such that the truss beam 10 extends across the cooling tube array 15.

The first and second supports 12, 14 are displaceable along the cooling tube array 15 in a horizontal direction, i.e. perpendicular to the longitudinal direction A of the truss beam 10, e.g. on rollers of the supports 12, 14. For example, the first and/or second support 12, 14 may be guided on a respective rail. The inclination of the direction A is adapted to the inclination of the cooling tube array 15 to be cleaned.

On the truss beam 10, there is arranged a nozzle carriage 16. The carriage 16 is suspended from the truss beam 10 and is movable in the longitudinal direction A of the truss beam 10.

The triangular truss beam 10 has three tubular chords or chord tubes, of which two upper or top chords 20 are arranged above a single lower chord 22. The chords 20, 22 are arranged in a triangular pattern, the apex of the triangular structure pointing down. Thus, the lower chord 22 is positioned centrally below the top chords 20.

On both sides of the truss beam 10, diagonal bracings 24 are arranged in a zigzag structure, such that two adjacent bracings 24 and a portion of one of the truss chords 20, 22 form a generally triangular structure, as is visible in FIG. 3. Thus, on each side, the respective top chord 20, the bottom chord 22 and the bracings 24 form a framework of two parallel chords 20, 22 interconnected by diagonal bracings 24 that are slanted in alternating directions.

The top chords 20 are connected by bracings or cross connectors 26 which, for example, are perpendicular to the chords 20, so that a rectangular, ladder-like framework is formed. In particular, the cross connectors 26 and the top chords 20 form a braced frame.

Figure 4:
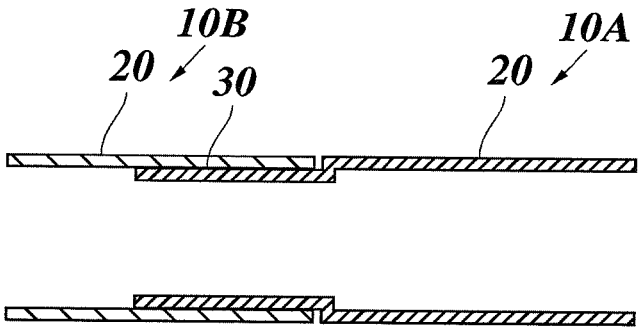
FIG. 4 schematically shows a connection of chords of truss beam sections.
Figure 5:
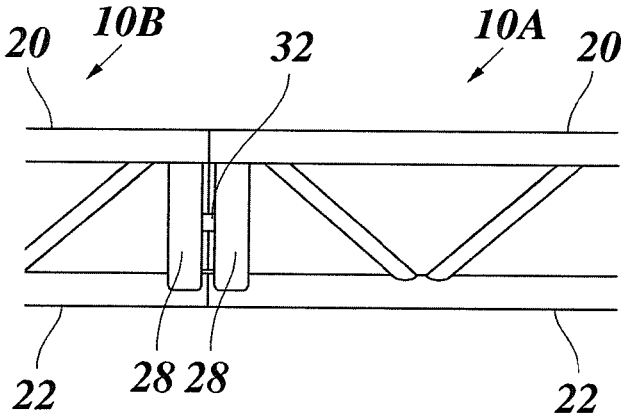
FIG. 5 schematically shows a connection of truss beam sections.

As FIG. 3 shows, the truss beam 10 is a segmented truss beam that is composed of truss beam sections 10A, 10B, 10C, . . . , which each have the above described triangular truss beam structure and, for example, a length of 4 meter, 3 meter or less. At the ends of the respective truss beam section, the chords 20, 22 of the truss beam section are interconnected by end connectors 28. The truss beam sections are connected lengthwise to form the truss beam 10. For example, the chords 20, 22 may have an open cylindrical end on one side, and a connector extension 30 of reduced diameter on the other side, wherein the connector extension is accommodated in the open end of the following chord, as schematically shown in FIG. 4. The end connectors 28 of neighboring truss beam sections may be connected by bolts 32 or the like. For example, the truss beam 10 may have a span of 10 meters. It may comprise a number of segments 10A, 10B, . . . having a uniform length of e.g. 3 meters, and, optionally, one shorter or longer segment for length adjustment.

For example, the triangular truss beam 10 may be adapted to be assembled on site by detachably connecting the truss beam sections 10A, 10B, etc.

The nozzle carriage 16 is shown in detail in FIG. 1 and FIG. 2. From bottom to top, the nozzle carriage 16 comprises a plurality of nozzles 40, a manifold in form of a rectangular frame tubing 42 to which the nozzles 40 are connected in parallel, a connection frame 44 connecting the frame tubing 42 to bottom roller mounting plates 46, said bottom roller mounting plates 46 on which two bottom chord rollers 48 are mounted to be rotatable about a horizontal axis, V-shaped end plates 50 that enclose the triangular truss beam 10 between the wings of the end plates 50. Optionally, the nozzle carriage 16 comprises top connectors 52 that connect the wings of a respective end plate 50 above and across the truss beam 10, such that the V-shaped end plate 50 and the top connector 52 fully enclose the cross-section of the truss beam 10, as is shown in FIG. 1.

The ends of the bottom roller mounting plates 46 are connected to base portions of the respective end plates 50. Top roller mounting plates 54 are connected to top portions of the respective end plates 50. The end plates 50, top connectors 52 and roller mounting plates 46, 54 form a cage structure, wherein the end plates 50 are arranged outside the truss beam 10 and are oriented perpendicular to the longitudinal direction A of the truss beam 10.

The bottom chord rollers 48 are supported by the bottom roller mounting plates 46 on both sides of the respective roller 48. Each bottom chord roller 48 is centrally positioned below the bottom chord 22 and is arranged perpendicular to the surface of the chord 22 at a mean position of contact with the circumferential surface of the chord 22. A circumferential surface of each bottom chord roller 48 has a circumferential groove that has an arc shaped concave cross-section adapted to the outer circumferential surface of the bottom chord 22. The circumferential groove engages a circumferential section of the bottom chord 22. Thereby, the bottom chord roller 48 is firmly guided along the bottom chord 22. The concave surface of the bottom chord rollers 48 preferably is symmetrically concave with respect to a center plane of the respective roller 48. As FIG. 1 shows, the bottom chord rollers 48 surround a substantial part of the cross section of the bottom chord 22.

On each of the two top roller mounting plates 54, that are arranged on opposite sides of the truss beam 10, two top chord rollers 58 are mounted to be rotatable about a horizontal axis. Thus, the axes of the top and bottom chord roller 58, 48 are parallel. The top chord rollers 58 are arranged on a top side of the respective top chord 20. Each top chord roller 58 has a concave, bell-shaped outer circumferential surface that has an arc shaped concave cross-section adapted to the outer circumferential surface of the top chord 20. In particular, on each side of the truss beam 10, the top chord rollers are arranged above as well as laterally with respect to the respective top chord 20, a base part having a larger diameter being arranged at a side that is laterally outward from the truss beam 10. Thereby, the top chord rollers 58 that are arranged on both sides of the truss beam 10 firmly guide the nozzle carriage 16 along the top chords 20.

As FIG. 1 shows, the V-shaped parallel front and back plates 50 rigidly connect bearings 48A of the bottom chord rollers 48 to bearings 58A of the top chord rollers 58 on both sides of the nozzle carriage 16. The wings of the V-shaped plates 50 together with the top and bottom roller mounting plates 46, 54 form left and right side parts of the nozzle carriage 16 and form a generally V-shaped bracket which surrounds the generally triangular outline of the triangular truss beam 10.

Since the bottom chord rollers 48 engage the bottom chord 22 from below, and the top chord rollers 58 engage the top chord 20 from above, the nozzle carriage 16 is firmly held to the truss beam 10 while being moveable in the longitudinal direction A of the truss beam 10. The top chord rollers 58 travel on respective top chords 20, whereas the bottom chord rollers 48 travel on the bottom chord 22.

The nozzles 40 are arranged in two parallel rows on straight sections of the rectangular frame tubing 42, which sections extend in a horizontal cross direction B that is perpendicular to the direction A. The nozzles have a common ejection direction C that is perpendicular to both directions A and B. The extension E of the nozzle rows roughly determines a slightly larger cleaning width W at a cleaning distance of the nozzles above the cooling tubes to be cleaned. The extension E covers a plurality of cooling tubes of the cooling tube array 15. FIG. 2 and FIG. 3 show different examples of distances between the two rows of nozzles 40.

When operating the cleaning apparatus, water is supplied to the nozzles 40 via at least one supply tube 60 and the manifold 42. The at least one supply tube 60 is connected to the manifold 42.

A carrier chain 62 is connected, at one end thereof, to the nozzle carriage. As FIG. 3 shows, the carrier chain 62 optionally is a limited-articulation carrier chain that permits bending from a straight configuration to one side only, the opposite side of which is also referred to as its "rigid" back.

The carrier chain 62 is arranged such that, in an intermediate position of the nozzle carriage 16 between opposite end positions of the movement range of the nozzle carriage 16 on the truss beam 10, the carrier chain 62 extends in a first direction from its connection to the nozzle carriage along a first portion 62A, makes a downward bend, and further extends in a direction opposite from said first direction and supported by a chain support 63 on top of the truss beam 10. Thus, the bend is a return bend. In the example shown, the carrier chain 62 extends in a self-supported manner in the first direction to the bend, and the bend angle is slightly less than 180°. However, the bend angle may also be 180° or more than 180°.

The first portion 62A of the supply tube 62 is, thus, positioned above the second portion 62B of the carrier chain 62, which second portion 62B directly rests on the chain support 63. In the example of FIG. 3, the "rigid back" is on the outside of the bend and maintains the self-supporting state of the first portion 62A.

When the nozzle carriage 16 is moved along the truss beam 10, the portions 62A and 62B of the carrier chain 62 vary, i.e. they have a varying length, and the first portion 62A is displaced with the nozzle carriage 10. The position of the bend moves with approximately half the speed of the nozzle carriage 10. When the connection of the carrier chain 62 to the nozzle carriage 16 is the leading end of the movement of the portion 62A, the length of the first portion 62A increases, and the length of the second portion 62B decreases. When the connection of the carrier chain 62 to the nozzle carriage 16 is the trailing end of the movement of the portion 62A, the length of the self-supported portion 62A decreases, and the length of the portion 62B increases. The carrier chain 62 is sufficiently long to allow the nozzle carriage 16 to reach its end positions while maintaining one part 62B-1 of portion 62B of the carrier chain 62 in a fixed position on the chain support 63. In particular, the carrier chain 62 has a length that is at least half the length of the traveling distance of the nozzle carriage 16 along the longitudinal direction of the truss beam 10.

The supply hose 60 is arranged in the free inside cross-section or internal space of the carrier chain 62, as is schematically shown in FIG. 1. Thus, the carrier chain carries the supply hose 60.

As is shown in FIG. 1, the top connectors 52 above the truss beam 10 are adapted to move above the portion 62B of the carrier chain 62 that is supported on the outside of the truss beam 10. Thus, the nozzle carriage 16 may pass at least a part of the portion 62B when moving in the first traveling direction D of increasing length of portion 62B. When the nozzle carriage 16 has passed said fixed position and moves further, an increasing part of the portion 62B of the carrier chain 62 is passed by the nozzle carriage 16. Thus, the nozzle carriage 16 fully encloses the cross section of the truss beam 10, and is adapted to fully enclose the cross section of the truss beam 10 including the chain support 63 and said portion 62B of the carrier chain 62 that has been laid onto the chain support 63 when moving in said first traveling direction and having passed said fixed position.

Instead of being positioned directly outside the truss beam 10 and arranged to be enclosed by the nozzle carriage 16, the chain support 63, carrier chain 62 and supply hose 60 may also be arranged to the side of the truss beam 10, as is indicated in FIG. 1 by dashed lines. For example, the chain support 63 may extend parallel to the truss beam 10 and with lateral distance to the truss beam 10 and may be supported by the supports 12, 14.

A belt drive is arranged to move the nozzle carriage 16 along the longitudinal direction A of the truss beam 10. As is shown in FIGS. 1 and 2, the belt drive comprises a drive belt 64 in the form of a toothed belt that is attached to the nozzle carriage 16. As shown in FIG. 3, the drive belt 64 runs over pulleys 66, 68 arranged at the opposite ends of the truss beam 10. A motor 70 that drives a pulley 66 is mounted to the truss beam 10. For example, the drive pulley 66 is a toothed pulley.

Instead of a carrier chain 62 that permits bending from a straight configuration to one side only, the carrier chain 62 may be a slack carrier chain. Then, for example, said first portion 62A is permitted to rest on the second portion 62B, as is shown with a dashed line in FIG. 3. For example, side walls of the chain support 63 may have a height larger than a cross-sectional height of the carrier chain 62, so that the first portion 62A may be secured on top of the second portion 62B.

Different from the above described examples, the nozzle carriage 16 may also comprise a gap 71 (FIG. 6) that completely separates the side parts of the nozzle carriage 16 above the truss beam 10.

Figure 6:
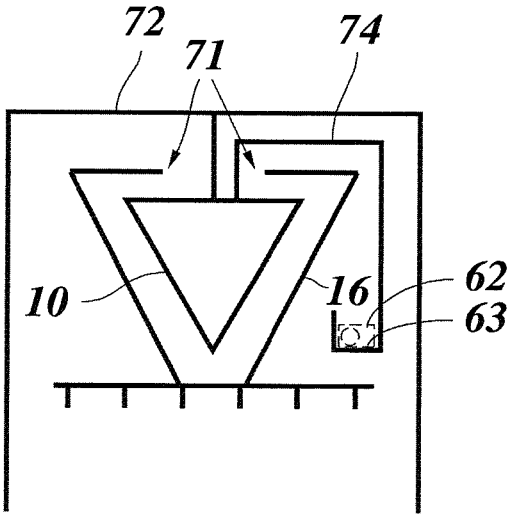
FIG. 6 is a schematic view of a further embodiment of the nozzle carriage and a support of the truss beam.

In particular, the truss beam 10 may be suspended from a support 72 and may extend on both sides of the support. The gap may allow the nozzle carriage 16 to pass the mounting suspension that supports the truss beam 10, as is schematically shown in FIG. 6. Therefore, the truss beam 10 may extend beyond the support 72. For example, a support 72 may replace one or each of the above described supports 12, 14.

Furthermore, for example, when the chain support 63 is arranged to the side of the truss beam 10, the chain support 63 may be suspended from a boom 74 that is connected to the truss beam 10, and said gap may allow the nozzle carriage 16 to pass the boom 74, as is also schematically shown in FIG. 6.

Figure 7:
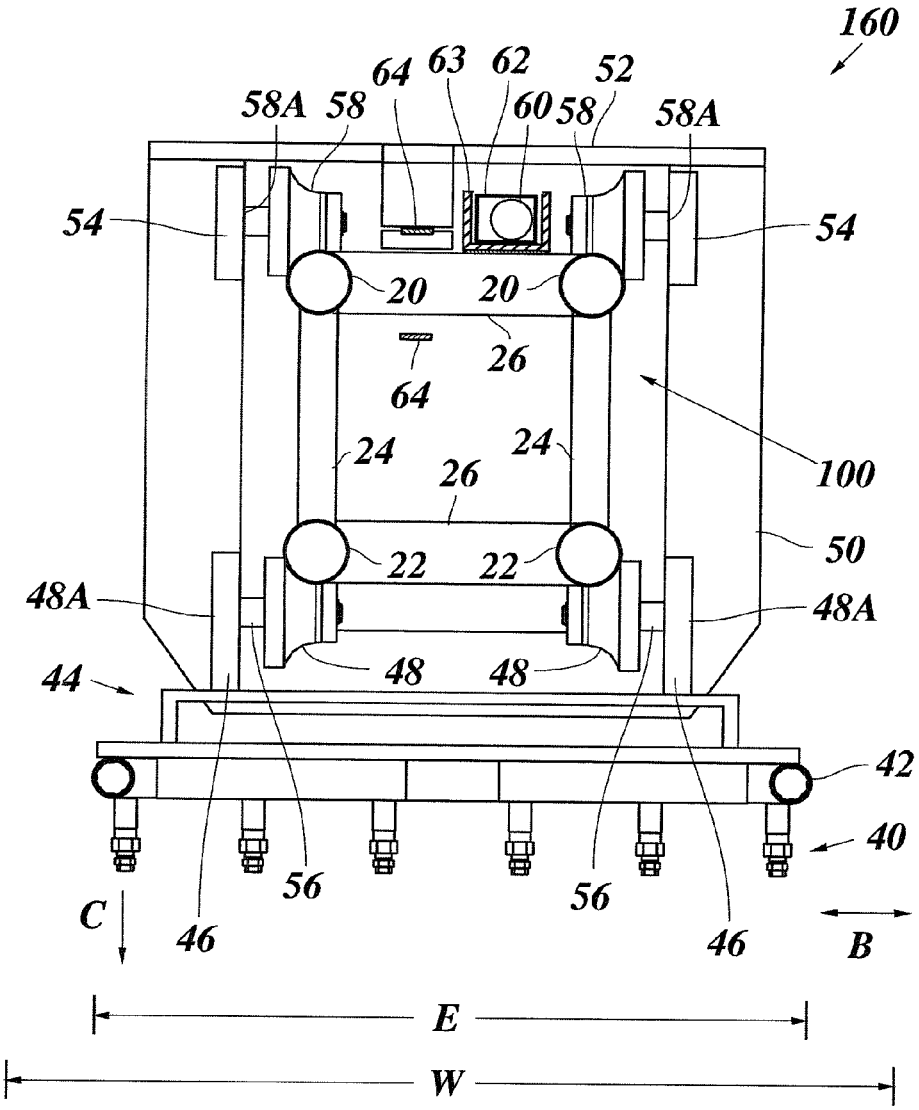
FIG. 7 is a schematic transverse sectional view of a square truss beam and a nozzle carriage of a further embodiment of a cleaning apparatus.

FIG. 7 schematically shows a cleaning apparatus according to an embodiment having a square truss beam 100 instead of the triangular truss beam 10. The truss beam 100 has two top chords 20 and two bottom chords 22. A nozzle carriage 160 has U-shaped end plates 50 that enclose the square truss beam 100 between the wings of the end plates 50. The other features correspond to the above described examples. The same or corresponding parts are indicated with the same reference signs and correspond to the above description with respect to the embodiment of FIG. 1.

The bottom chord rollers 48 are arranged on a bottom side of the respective bottom chord 22. The bottom rollers 48, in this example, have a concave, bell-shaped outer circumferential surface that has an arc shaped concave cross-section adapted to the outer circumferential surface of the bottom chord 22. In particular, on each side of the truss beam 100, the bottom chord rollers 48 are arranged below as well as laterally with respect to the respective bottom chord 22, a base part having a larger diameter being arranged at a side that is laterally outward from the truss beam 100. Thereby, the bottom chord rollers 48 that are arranged on both sides of the truss beam 100 firmly guide the nozzle carriage 160 along the bottom chords 22.

The wings of the U-shaped plates 50 together with the top and bottom roller mounting plates 46, 54 form left and right side parts of the nozzle carriage 160 and form a generally U-shaped bracket which surrounds the generally square outline of the truss beam 100.

Whereas the cleaning apparatus described above may be assembled on site and e.g. temporarily mounted on a cooling tube array, the cleaning apparatus may also be permanently mounted to a heat exchanger to be displaceable over a cooling tube array.

Other variations to the disclosed embodiments can be understood and effected by those skilled in the art in practicing the claimed invention, from a study of the drawings, the disclosure, and the appended claims. Furthermore, all the disclosed elements and features of each disclosed embodiment of the cleaning apparatus can be combined with, or substituted for, the disclosed elements and features of every other disclosed embodiment of the cleaning apparatus, respectively, except where such elements or features are mutually exclusive. For example, in the example of FIG. 7, the carrier chain may be positioned according to the different examples of FIG. 1 and FIG. 6. The square truss beam may also be combined with a nozzle carriage having the gap 71 and may have supports 12, 14 and/or 72 of FIGS. 3 and 6.

The mere fact that certain measures are recited in mutually different dependent claims does not indicate that a combination of these measured cannot be used to advantage.

In the claims, the word "comprising" does not exclude other elements or steps, and the indefinite article "a" or "an" does not exclude a plurality. Any reference signs in the claims should not be construed as limiting the scope.

What is claimed is:

1. A cleaning apparatus for cleaning a cooling tube array of a heat exchanger, comprising:

a triangular truss beam supported to be movable in a first direction, which direction is perpendicular to a longitudinal direction of the truss beam, a nozzle carriage movably held on the truss beam, the nozzle carriage being movable along the longitudinal direction of the truss beam, and a plurality of cleaning nozzles mounted to the nozzle carriage, wherein the truss beam comprises two tubular top chords, one tubular bottom chord that is arranged centrally below the top chords, and bracings that connect the chords, wherein the nozzle carriage comprises at least one bottom chord roller that is arranged for traveling on a bottom side of the bottom chord, and wherein the at least one bottom chord roller has a circumferential groove on a circumferential surface thereof which engages a circumferential section of the bottom chord.

2. The cleaning apparatus according to claim 1, wherein a respective axis of the at least one bottom chord roller is arranged in said first direction.

3. The cleaning apparatus according to claim 1, wherein each of the top chords of the triangular truss beam is connected to the bottom chord by ones of said bracings that form a zigzag structure.

4. The cleaning apparatus according to claim 1, wherein the nozzle carriage comprises top chord rollers that are arranged for traveling on the top chords, and wherein the nozzle carriage comprises left and right side parts that form a generally V-shaped bracket which encloses a generally triangular outline of the triangular truss beam, and which connect at least one bearing of the at least one bottom chord roller to bearings of the top chord rollers.

5. The cleaning apparatus according to claim 1, wherein the nozzle carriage fully encloses a cross section of the truss beam.

6. A cleaning apparatus for cleaning a cooling tube array of a heat exchanger comprising:

a transverse beam supported to be movable in a first direction, which direction is perpendicular to a longitudinal direction of the truss transverse beam, a nozzle carriage movably held on the transverse beam, the nozzle carriage being movable along the longitudinal direction of the transverse beam, a plurality of cleaning nozzles mounted to the nozzle carriage, a carrier chain, and a supply tube connected to the plurality of cleaning nozzles, wherein the supply tube is installed along the carrier chain, wherein, at one end of the carrier chain, the carrier chain is connected to the nozzle carriage, wherein, distant from said one end, a part of the carrier chain is supported outside of the transverse beam in a position such that the nozzle carriage is enabled to pass said part when moving in a first traveling direction along the transverse beam, by moving in which direction an increasing portion of the carrier chain is laid onto a chain support, and wherein the transverse beam comprises a tubular bottom chord, and the nozzle carriage comprises at least one bottom chord roller that is arranged for traveling on a bottom side of the bottom chord.

7. The cleaning apparatus according to claim 6, wherein said part of the carrier chain is supported on top of the transverse beam, and wherein said chain support is arranged on top of the transverse beam.

8. The cleaning apparatus according to claim 6, wherein the nozzle carriage fully encloses a cross section of the transverse beam, and is adapted to fully enclose a combined cross section of the transverse beam, said chain support, and said portion of the carrier chain that has been laid onto the chain support when moving in said first traveling direction and having passed said position.

9. A cleaning apparatus for cleaning a cooling tube array of a heat exchanger, comprising:

a square truss beam supported to be movable in a first direction, which direction is perpendicular to a longitudinal direction of the truss beam, a nozzle carriage movably held on the truss beam, the nozzle carriage being movable along the longitudinal direction of the truss beam, and a plurality of cleaning nozzles mounted to the nozzle carriage, wherein the truss beam comprises four tubular chords and bracings that connect the chords, and wherein the nozzle carriage comprises only bottom chord rollers, of which each bottom chord roller is arranged for traveling on a bottom side of a respective bottom one of the chords, and only top chord rollers, of which each top chord roller is arranged for traveling on a top side of a respective upper one of the chords.

10. The cleaning apparatus according to claim 9, wherein a respective axis of each bottom chord roller is arranged in said first direction.

11. The cleaning apparatus according to claim 9, wherein each bottom chord roller has a circumferential groove on a circumferential surface thereof which engages a circumferential section of said bottom chord.

12. The cleaning apparatus according to claim 9, wherein, on at least two sides of the square truss beam, the respective chords are connected by ones of said bracings that form a zigzag structure.

13. The cleaning apparatus according to claim 9, wherein the square truss beam has two top chords and two bottom chords, and wherein the bottom chord of the nozzle carriage comprise bottom chord rollers that are arranged for traveling on a bottom side of the bottom chords, and wherein the nozzle carriage comprises left and right side parts that form a generally U-shaped bracket which encloses a generally square outline of the square truss beam, and which connect bearings of the bottom chord rollers to at least one bearing of the top chord rollers.

14. The cleaning apparatus according to claim 9, wherein the nozzle carriage fully encloses a cross section of the truss beam.

15. The cleaning apparatus 1, wherein the plurality of cleaning nozzles comprises at least one row of cleaning nozzles that are connected in parallel to a common supply tube that is arranged below the triangular truss beam and extends across the longitudinal direction of the truss beam.

* * * * *